United States Patent [19]

Kapala et al.

[11] Patent Number: 5,054,237

[45] Date of Patent: Oct. 8, 1991

[54] VEHICLE SAFETY BARRIER

[75] Inventors: Fred J. Kapala, Roscoe; Robert A. Kapala, Belvidere, both of Ill.

[73] Assignee: Rockford Ornamental Iron Incorporated, Loves Park, Ill.

[21] Appl. No.: 553,130

[22] Filed: Jul. 16, 1990

[51] Int. Cl.[5] ..... E01F 13/00

[52] U.S. Cl. ..... 49/35; 49/49; 49/131; 52/111; 404/6

[58] Field of Search ..... 52/111, 113; 256/1; 49/35, 49, 131, 30; 404/6

[56] References Cited

U.S. PATENT DOCUMENTS

| | | | |
|---|---|---|---|
| 2,913,906 | 11/1959 | Sinclair | 49/35 |
| 3,660,935 | 5/1972 | Boots | 49/35 |
| 3,866,624 | 2/1975 | Peterson | 137/236.1 |
| 4,003,161 | 1/1977 | Collins | 49/35 |
| 4,050,109 | 9/1977 | Mazzone | 49/35 |
| 4,186,521 | 2/1980 | Hunter | 49/30 |
| 4,577,991 | 3/1986 | Rolow | 49/49 |
| 4,715,742 | 12/1987 | Dickinson | 404/6 |
| 4,880,081 | 11/1989 | Congleton | 52/180 |

FOREIGN PATENT DOCUMENTS

| | | | |
|---|---|---|---|
| 48004 | 4/1980 | Netherlands | 49/35 |

*Primary Examiner*—Richard E. Chilcot, Jr.
*Assistant Examiner*—Robert J. Canfield
*Attorney, Agent, or Firm*—Leydig, Voit & Mayer

[57] ABSTRACT

A post is adapted to be raised to an active position in front of a vehicle being serviced from a pit beneath the vehicle, the post serving as a barrier to guard against injury and property damage in the event the vehicle suddenly lurches forwardly. After the vehicle has been serviced, the post may be lowered to a stored position in the pit to enable the vehicle to be driven forwardly from the service area.

7 Claims, 2 Drawing Sheets

VEHICLE SAFETY BARRIER

BACKGROUND OF THE INVENTION

With the advent of self-service gasoline stations, fast service lube centers for vehicle oil changes and other routine maintenance have become very popular. In many of such lube centers, the vehicle is driven into overlying relation with a pit and is serviced by one person in the pit and by another person above the pit.

After the oil of the vehicle has been changed, the service person above the pit usually starts the engine to check the oil pressure. In some cases, the service person may not be completely familiar with the vehicle and may start the engine while the transmission is in gear or may inadvertently hit the accelerator pedal. As a result, the vehicle may suddenly lurch forward and injure anyone who might be standing in front of the vehicle. In some cases, the vehicle lurches forwardly through the exit door of the lube center.

SUMMARY OF THE INVENTION

The general aim of the present invention is to provide a new and easily usable barrier which serves as a safety stop in a fast-change lube center and which significantly reduces the danger of personal injury or property damage if a vehicle is unintentionally permitted to lurch forward.

A more detailed object of the invention is to achieve the foregoing through the provision of a safety barrier in the form of a post which is normally in a lowered stored position at floor level but which may be raised to an active position in front of the vehicle in order to stop the vehicle if the latter lurches forwardly.

Still further objects of the invention are to provide a safety post which may be easily raised and lowered and which is positively held both in its active position and in its stored position.

The invention also resides in the unique provision of a platform which closes off the pit between the safety post and the vehicle.

These and other objects and advantages of the invention will become more apparent from the following detailed description when taken in conjunction with the accompanying drawings.

DETAILED DESCRIPTION OF THE PREFERRED EMBODIMENT

Figure 1:
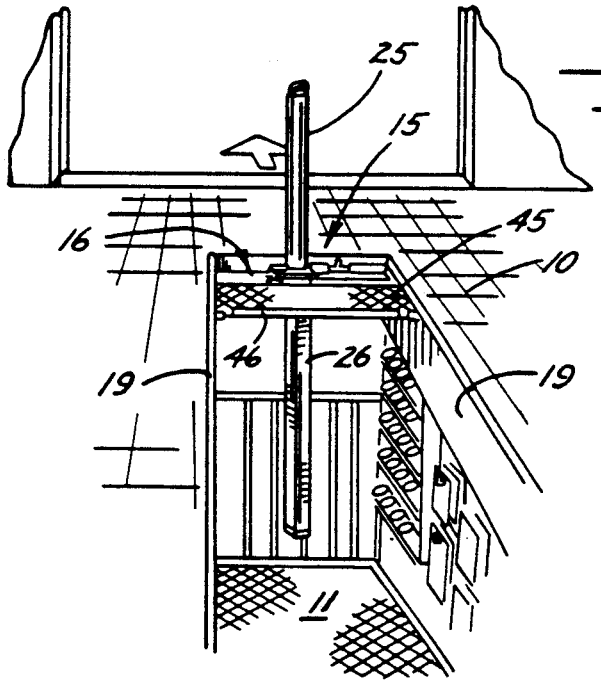
FIG. 1 is a fragmentary perspective view of the service bay of a typical fast-change lube center and shows the service pit of the bay equipped with a new and improved safety barrier incorporating the unique features of the present invention.

For purposes of illustration, the invention has been shown in conjunction with the bi-level service bay of a fast-change lube center for cars, vans and light trucks. The service bay includes a main floor 10 which supports the vehicle while the latter is being serviced. Much of the servicing is performed by a person standing beneath the vehicle in a pit 11 which is formed by constructing an opening through the floor in order to expose a lower level of the service bay.

After the oil of the vehicle has been changed by the service person in the pit 11, the upper level service person usually starts the engine to check the oil pressure. If the vehicle should accidentally lurch forwardly, a person standing in front of the vehicle could be injured or the vehicle could burst through the exit door of the service bay.

The present invention contemplates the provision of a unique barrier 15 which serves as a safety stop for the vehicle while the latter is being serviced. After the service has been completed, the safety barrier is rendered inactive so as to enable the vehicle to be driven out of the service bay.

More specifically, the safety barrier 15 includes a main supporting framework 16 which extends across the upper side of the forward end portion of the pit 11 just below the level of the floor 10. While the framework may be of various constructions, it herein is formed by upper and lower generally rectangular and horizontal plates 17 made of heavy steel and extending transversely across the pit. C-shaped channels 18 which also are made of heavy steel are welded to the front and rear edges of the plates 17. At their ends, the plates and the channels are welded to steel plates 19 (FIG. 2) which extend along opposite sides of the pit 11. The forward channel 18 is also welded to a steel plate 20 at the front of the pit. Thus, the framework 16 is very strong and is rigidly tied to the floor structure 10.

Pursuant to the invention, the framework 16 supports a post 25 which serves as the safety stop. In this instance, the post is cylindrical and is made of extra strong pipe. The preferred post is approximately 4' long, is approximately 3" in diameter and weighs about 42 pounds.

The post 25 is guided for up and down sliding in a sleeve 26 which is secured rigidly to the framework 16 and which extends downwardly therefrom into the pit 11. The sleeve is approximately 4" square and its upper end portion extends upwardly through a square opening in the framework 16. Welds (not visible) secure the upper end portion of the sleeve to the framework. A steel bar 27 (FIG. 4) is welded to the front channel 18 and is interposed between the plate 20 and the front of the sleeve to reinforce the sleeve against a hard impact on the post 25.

Figure 3:
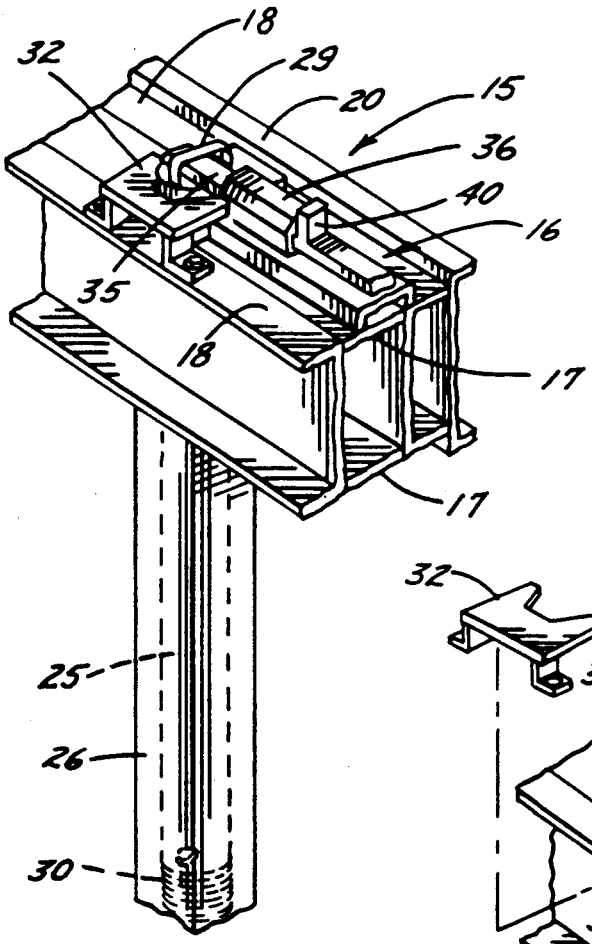
FIG. 3 is a fragmentary perspective view showing the post of the safety barrier in its stored position.

Normally, the post 25 is disposed in a lowered stored position in the sleeve 26 as shown in FIG. 3. When the post is in this position, its upper end is disposed substantially flush with the upper side of the framework 16 and thus a vehicle may be driven out of the service bay without interference from the post.

When a vehicle is driven into the bay, the post 25 is raised upwardly to an active position (FIGS. 1 and 2) so as to present a barrier to unintentional forward lurching of the vehicle. A handle 29 on the upper end of the post facilitates lifting of the post to its raised position. Since the post is quite heavy, a coil spring 30 is telescoped into the sleeve 26 and is compressed between the lower end of the post and the closed lower end 31 (FIG. 2) of the sleeve. The spring is loaded when the post is pushed downwardly to its stored position and thus reduces the manual force required to lift the post to its active position.

Figure 4:
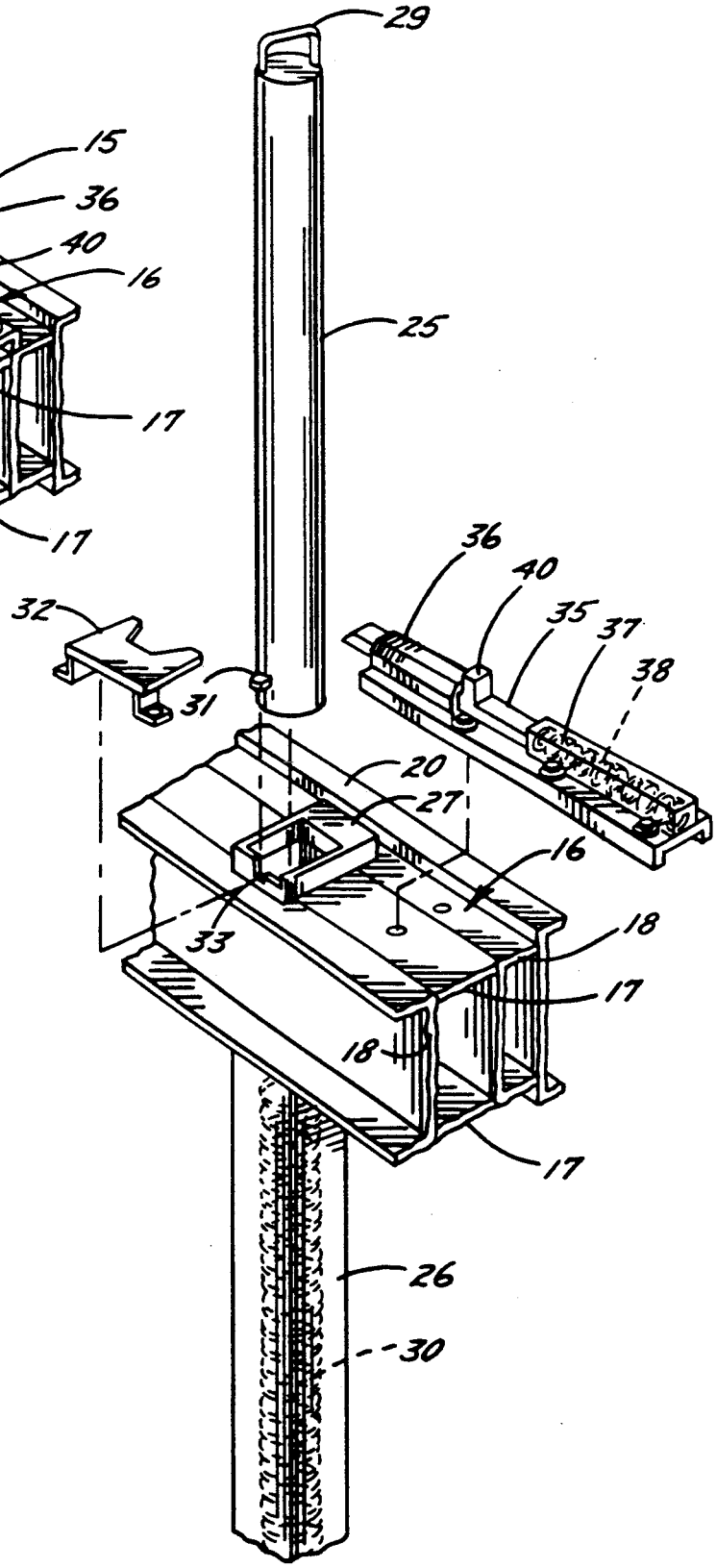
FIG. 4 is an exploded perspective view of the primary components of the safety barrier.

As shown in FIG. 4, a lug 31 is secured to and projects radially from the lower end portion of the post 25. When the post is in its stored position, the post is oriented angularly such that the lug is located in one of the rear corners of the sleeve 26. When the post is raised fully upwardly to its active position, the lug strikes a plate 32 secured to the upper side of the framework 16 and overlying the rear upper end portion of the sleeve in vertically spaced relation therefrom. Striking of the lug against the plate signals the service person that the post has reached its active position. Thereafter, the service-person rotates the post to align the lug angularly with a notch 33 (FIG. 4) in the upper end of the sleeve. The post then is lowered slightly to allow the lug to seat in the notch and hold the post upwardly in its active position.

Because the spring rate of the spring 30 varies from spring-to-spring, the spring may cause the upper end of the post 25 to project some distance above the framework 16 when the post is in its stored position. To prevent the post from projecting upwardly beyond an acceptable distance, means are provided for latching the post in its stored position and for keeping the upper end of the post flush with the upper end of the framework. Herein, these means comprise a latching plunger 35 which is supported to slide in housing sections 36 and 37 secured to the upper side of the framework 16. A coil spring 38 (FIG. 4) is located in the housing section 37 and urges the plunger 35 to slide toward the post 25 along a path extending radially of the post.

Figure 2:
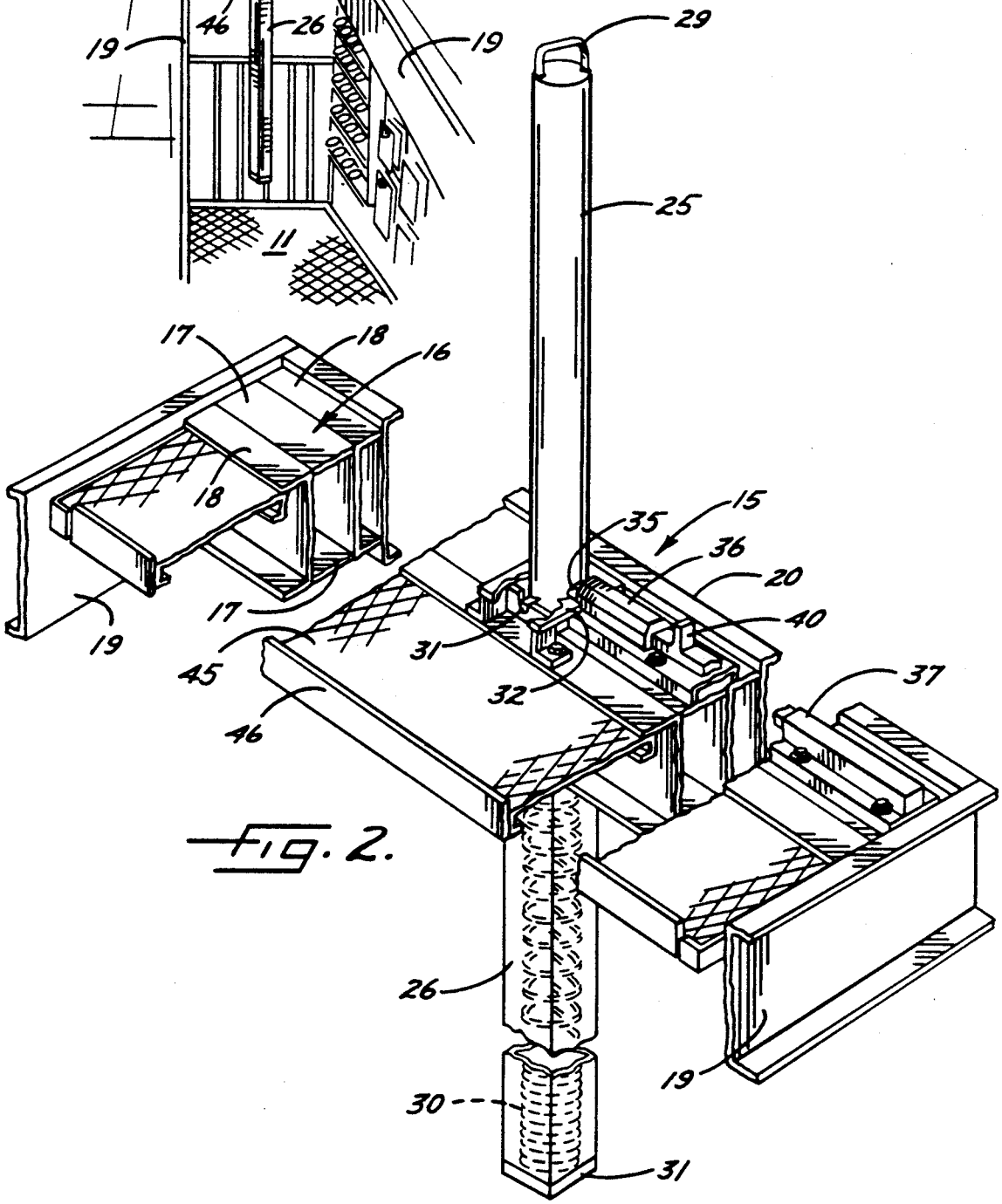
FIG. 2 is an enlarged fragmentary perspective view of the safety barrier and the front portion of the service pit shown in FIG. 1, the post of the safety barrier being shown in its active raised position.

When the post 25 is in its active position, the nose of the plunger 35 is pressed against one side of the post as shown in FIG. 2. When the post is lowered to its stored position, the spring 38 snaps the plunger 35 across the top of the post as soon as the post moves below the plunger (see FIG. 3). Thus, the plunger prevents the spring 30 from causing the stored post to poke upwardly beyond the framework 16. To release the plunger, a lug 40 on the upper side of the plunger may be gripped to retract the plunger away from the post. The lug 40 also engages the housing section 36 and serves as a stop for the plunger when the latter is in its latched position.

When a vehicle is driven into the service bay, it is desirable to stop the vehicle short of the post 25 in order to prevent the vehicle from impacting against the post and to avoid possible damage to the bumper or front license plate of the vehicle. Thus, the service person directs the driver to pull the vehicle forward until the bumper is about a foot short of the post. In order to close off the pit between the post and the front of the vehicle, a horizontal platform 45 (FIG. 2) is secured to the rear side of the framework 16 and overhangs the front portion of the pit 11. The platform is preferably made of expanded metal and enables the service person to stand between the post 25 and the front of the vehicle if necessary in order to service the vehicle. A plate 46 is secured to and projects upwardly from the rear edge of the platform and serves as a toe kickplate to warn the service person and others against stepping off of the rear of the platform.

From the foregoing, it will be apparent that the present invention brings to the art a new and improved safety barrier 15 in which a post 25 is raised from the pit 11 of a service bay in order to stop unintentional forward movement of a vehicle. The post is easy to operate, helps guard against personal injury and property damage and may be quickly stored in an inactive position in the pit.

We claim:

1. The combination of, a vehicle lubrication service pit having front and rear end portions, and a vehicle barrier selectively operable to form a safety stop adjacent the front end portion of the pit for a vehicle disposed above the pit for servicing, said barrier comprising a framework secured to the front end portion of said pit near the upper side thereof, a sleeve secured to and depending from said framework and extending downwardly into the front end portion of the pit, a barrier post supported slidably within said sleeve for up and down movement between a raised active position and a lower stored position, said post presenting an obstacle to forward movement of the vehicle when in said active position and being located below and clear of the undercarriage of the vehicle when in said stored position, means for urging said post upwardly toward said active position, and means independent of said urging means for holding said post in said active position and selectively releasable to permit lowering of said post to said stored position.

2. The combination defined in claim 1 in which said urging means comprise a spring acting between said post and said sleeve and serving to urge said post upwardly when said post is in said stored position.

3. The combination defined in claim 2 in which said spring is a coil spring disposed in said sleeve and compressed between said sleeve and said post.

4. The combination defined in claim 2 further including means for retaining said post downwardly in said stored position against the force of said spring and selectively releasable to permit said post to move upwardly to said active position.

5. The combination defined in claim 4 in which said retaining means comprise a latch supported by said framework to slide toward and away from said post along a path extending generally radially of said post, a second spring between said latch and said framework and urging said latch toward said post, said latch being urged against one side of said post when said post is in said active position and snapping into overlying engagement with the upper end of said post as said post is lowered into said stored position.

6. The combination defined in claim 1 further including a generally horizontal platform supported by said framework and located adjacent the lower end portion of said post when said post is in said active position, said platform extending across and overhanging one end portion of said pit and defining a standing area between the vehicle and the post.

7. The combination defined in claim 6 further including a toe plate projecting upwardly from and extending across one side of said platform

* * * * *